US006459198B1

(12) United States Patent
Dean et al.

(10) Patent No.: US 6,459,198 B1
(45) Date of Patent: Oct. 1, 2002

(54) SEAL AND METHOD OF SEALING DEVICES SUCH AS DISPLAYS

(75) Inventors: Kenneth A. Dean, Phoenix, AZ (US); Babu R. Chalamala, Chandler, AZ (US); Dave Uebelhoer, Tempe, AZ (US); Craig Amrine, Tempe, AZ (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/572,157

(22) Filed: May 17, 2000

(51) Int. Cl.[7] ..... H01J 9/26
(52) U.S. Cl. ..... 313/493; 445/25; 445/41
(58) Field of Search ..... 445/24, 25, 41; 228/124.6; 313/493, 495

(56) References Cited

U.S. PATENT DOCUMENTS

| | | | | |
|---|---|---|---|---|
| 3,777,281 A | * | 12/1973 | Hochuli | 228/124.6 |
| 4,182,540 A | | 1/1980 | Frankland et al. | |
| 4,582,210 A | | 4/1986 | Morimoto et al. | |
| 4,770,310 A | | 9/1988 | Morimoto et al. | |
| 5,797,780 A | | 8/1998 | Peng | |
| 5,897,927 A | | 4/1999 | Tsai et al. | |
| 6,007,397 A | | 12/1999 | Ju et al. | |
| 6,261,145 B1 | | 7/2001 | Lee et al. | |

FOREIGN PATENT DOCUMENTS

| | | |
|---|---|---|
| JP | 2718273 | 10/1977 |
| JP | 59189534 | 10/1984 |
| JP | 62259329 | 11/1987 |
| JP | 0838834 | 4/1998 |
| JP | 0895268 | 2/1999 |
| JP | 2000251731 | 9/2000 |
| JP | 19936863 | 2/2001 |
| JP | 19936865 | 2/2001 |

* cited by examiner

*Primary Examiner*—Kenneth J. Ramsey
(74) *Attorney, Agent, or Firm*—Kevin D. Wills; William E. Koch

(57) ABSTRACT

A method of fabricating a high vacuum display with flat form factor, and the display, include an envelope with two major, parallel spaced apart glass sides and a continuous edge therebetween. An opening is formed through one of the glass sides of the envelope. A plate is provided with an area larger than the opening in the envelope. A button with an area slightly smaller than the opening may be formed on one side of the plate. A low temperature melting material is positioned on the plate around the button and the envelope is positioned in a substantial vacuum. The button is placed in the opening with the plate abutting the glass side outside of the envelope and the low temperature melting material is melted using heat and/or pressure to sealingly engage the button within the opening.

20 Claims, 2 Drawing Sheets

SEAL AND METHOD OF SEALING DEVICES SUCH AS DISPLAYS

FIELD OF THE INVENTION

This invention relates to a seal and a method of sealing field emission devices and more particularly, to a high vacuum seal in devices with a flat profile.

BACKGROUND OF THE INVENTION

Flat panel displays incorporating field emission devices require good vacuum conditions for peak performance and long operating lifetimes. The method in which the vacuum seal is made greatly influences the overall vacuum conditions. Because field emission displays have a larger surface area-to-volume ratio than almost any other vacuum product, the task of producing good vacuum is much more difficult than in other vacuum devices.

There are problems with using established methods to make a seal in field emission displays. One prior art sealing method is commonly referred to as the "tubulator tip-off" method and is used to seal a completely glass enclosure. In this method, the act of melting the tip-off area of the glass with heat during the tip-off produces a pressure burst that sets the initial vacuum level within the enclosure at $10^{-5}$ torr or greater. A tubular stump remains on the back of the display, which reduces the flat form factor of the final product.

A second prior art sealing method is commonly referred to as an "integral seal". The display is generally sealed in one step at high temperature using a frit or other means, and up to 1 torr of gas can be deposited within the display envelope during the sealing process. This gas must be removed with additional gettering including flashable getters and non-evaporable getters. Significant expense is incurred to clean up the vacuum envelope to levels required for field emission.

Thus, there is a need for a sealed vacuum envelope and method of producing the sealed vacuum envelope for a field emission display which has a flat form factor, produces as low a pressure as possible at the seal, and allows for the activation of a getter within the envelope.

BRIEF DESCRIPTION OF DRAWINGS

Referring to the drawings.

DESCRIPTION OF THE PREFERRED EMBODIMENTS

Figure 1:
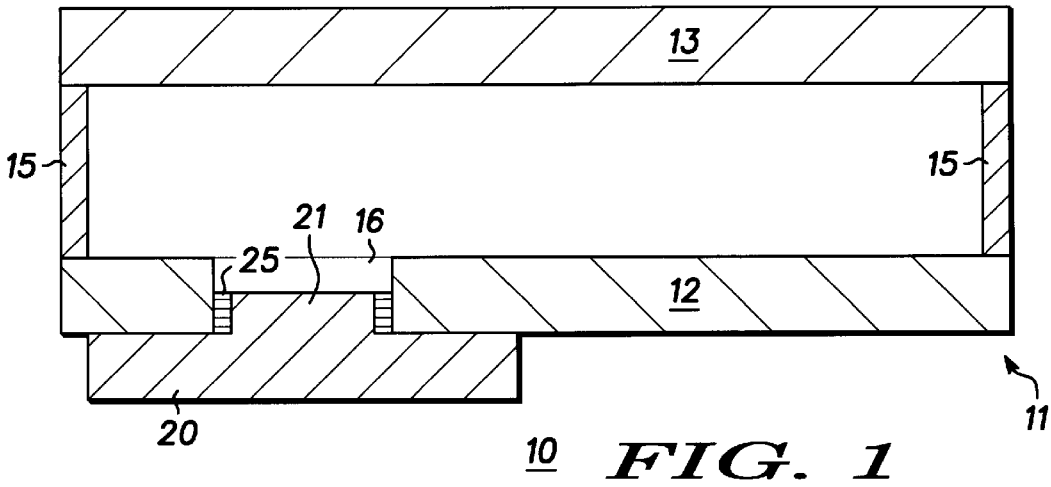
FIG. 1 is a sectional view of a field emission device envelope sealed in accordance with the present invention.

Turning now to the figures and specifically to FIG. 1, a high vacuum field emission display 10 with flat form factor is illustrated. Display 10 includes an envelope 11 including two major, parallel spaced apart glass sides 12 and 13 with a continuous edge 15 therebetween. Generally, as will be understood by those skilled in the art, an electronic device is housed within envelope 11 which requires a relatively high vacuum for the proper operation thereof. Display 10 includes some type of electronic device, such as a field emission device (FED), to produce pictures, writing, etc. Since FEDs are well known in the art, no further description of the structure or operation is believed necessary, except to state that in this example glass side 12 may be the cathode and glass side 13 may be the anode upon which the pictures, etc. are formed or sides 12 and 13 may be reversed. Further, while the term "glass" is used to describe both sides 12 and 13, it will be understood by those skilled in the art that any material (e.g., ceramic, semiconductor, metal, metal-ceramic multilayers, etc.) can be used for sides 12 and 13 and for edge 15 which provides a reasonable vacuum seal (e.g. a leak rate less than approximately $2\times10^{-13}$ torr×liters/sec) and the term "glass" is intended to incorporate all such materials.

Figure 2:
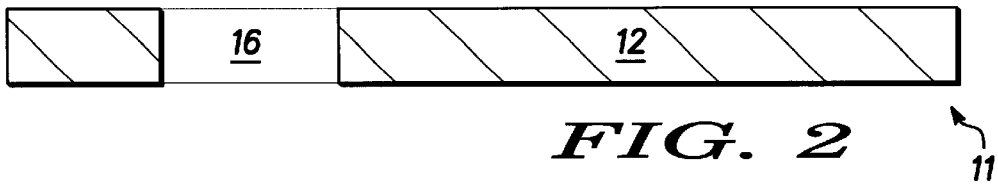
FIGS. 2 through 7 illustrate sequential steps in the sealing process.
Figure 3:
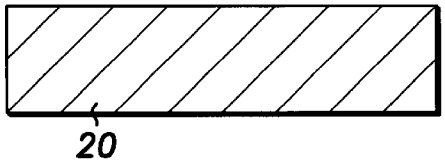
Figure 4:
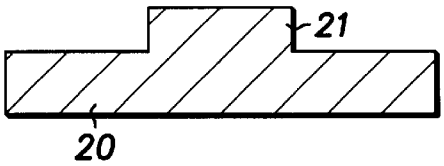

Referring to FIG. 2, an opening 16 is formed through one of the glass sides, in this embodiment side 12, to provide access to the inner volume defined by envelope 11. The process then requires the evacuation of the volume within envelope 11 and sealing of opening 16. To accomplish this, a covering element or plate 20 is provided, (see FIG. 3) and a button 21 is formed on one side, as illustrated in FIG. 4. Here it will be understood that in this preferred embodiment plate 20 and button 21 are formed as an integral unit but other configurations may be devised, as will be explained in more detail below. Generally, for simplicity in fabrication, opening 16 is round and plate 20 has an area larger than the area of opening 16. It will of course be understood that other shapes of openings and plates can be used if desired. Button 21 has an area slightly smaller than the area of opening 16 so that it can be easily positioned within opening 16, as illustrated in FIG. 1. Here it should be noted that plate 20/button 21 can be thinner than 1 mm, less than 5 mm in diameter, and can be attached to either the anode or the cathode to provide the appropriate form factor.

Figure 5:
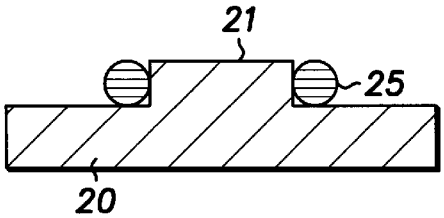

With envelope 11 and plate 20 and button 21 formed as described, the preferred assembly process is generally as follows. A low temperature melting material 25 is positioned on plate 20 around button 21, generally as illustrated in FIG. 5. Material 25 is any ultra-high vacuum material that remains solid at normal operating temperatures (e.g., 100° C.) and has a melting point below the softening point of glass frit (e.g., 300° C.). At least button 21 (and also plate 20 in the preferred embodiment) is formed from a material that wets well to low temperature melting material 25 and remains wetted at high temperatures. Materials which react favorably are, for example, copper and gold. Also, examples of low temperature melting material 25 which operate well in the present process are indium and tin alloys composed of several materials and different amounts to provide the desired properties. In the preferred embodiment, plate 20 and button 21 are formed integrally of copper and low temperature melting material 25 is indium. Material 25 (indium) is placed in a ring or plate on button 21, as illustrated in FIG. 5.

It should be noted that the button material can be any material coated with an indium wettable material. However, molten indium rapidly forms a eutectic and will consume most thin and thick film materials in high temperature processing. Thus, it is preferable to use a solid metal button 21/plate 20 to avoid depletion of the wettable material.

The indium is heated on button 21/plate 20 in vacuum to wet the surface, to outgas the indium metal, and to outgas the copper of button 21/plate 20. When cooled, the indium coated button is ready for sealing. The indium coated button is not removed from vacuum again before seal to prevent the formation of surface oxides which impede the formation of a quality seal. In the event that such oxides are formed, they can be removed with a hydrogen plasma before seal to improve adhesion.

Figure 6:
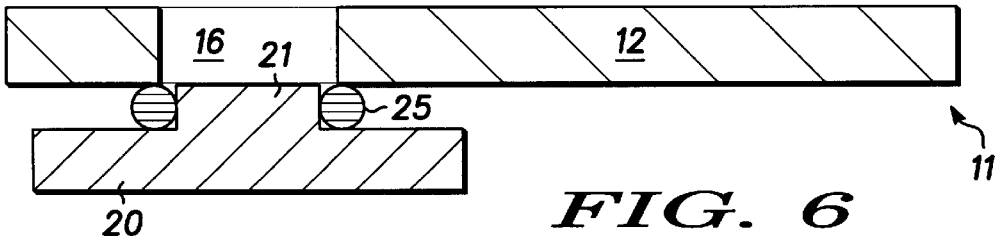
Figure 7:
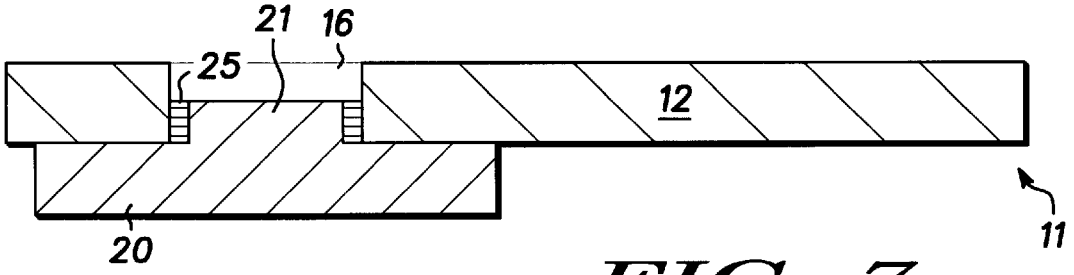

The final seal of button 21 to envelope 11 is made in high vacuum. This assures high vacuum in envelope 11 at seal. In one embodiment, button 21/plate 20 and indium 25 are heated above 157° C. The molten indium and button 21 are pressed into opening 16 of glass side 12, as illustrated in FIGS. 6 and 7. Because of delays, etc. in the fabrication process, there may be a surface film on the molten indium which has reduced adhesion. When the molten indium is pressed onto the glass of side 12, fresh indium with a clean surface is squeezed out underneath this film to make a very good chemical bond and a hermetic seal. Agitation of plate 20 and button 21 by rotation, vibration, or translation helps break up the surface film and improve adhesion in the initial contact area. The bond is complete when the indium solidifies on cooling.

Figure 8:
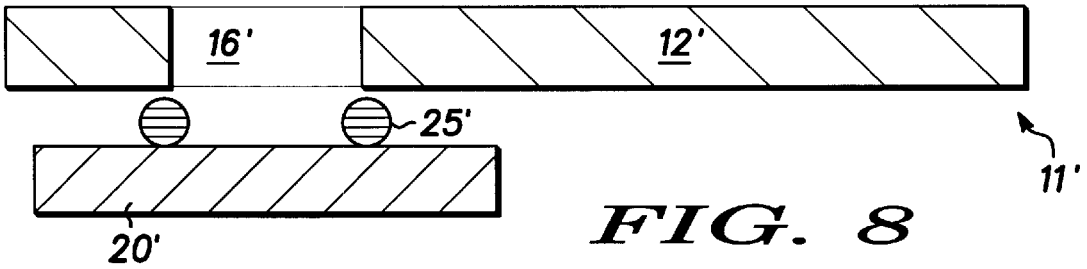
FIG. 8 is a sectional view of another embodiment of a field emission device envelope sealed in accordance with the present invention.

While a seal including plate 20 and button 21 have been disclosed above, it should be understood that many other seals could be devised. Referring to FIG. 8, an example of another embodiment is illustrated in which components similar to those in FIG. 1 are designated with similar numbers and a prime is added to the numbers to indicate the different embodiment. An opening 16' is formed in glass side 12' of envelope 11'. A plate 20' is provided with an area larger than the area of opening 16'. In this embodiment, no button is formed on plate 20'. A ring of low temperature melting material 25' similar to that described above, is placed on the upper surface of plate 20'. The assembly process proceeds as described above.

Figure 9:
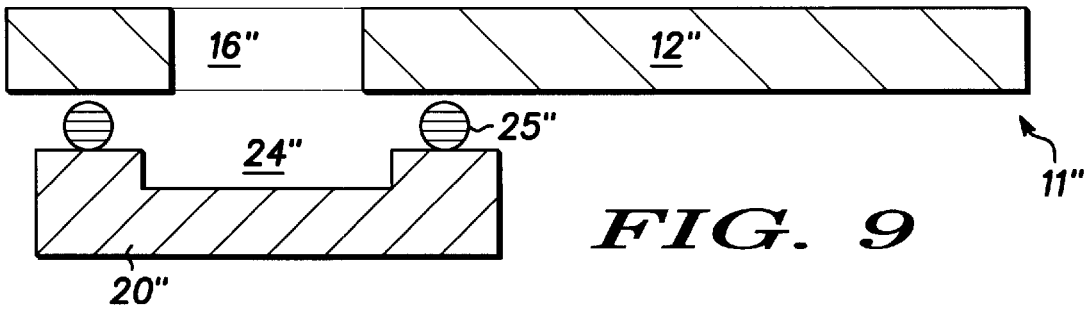
FIG. 9 is a sectional view of another embodiment of a field emission device envelope sealed in accordance with the present invention.

Referring to FIG. 9, an example of another embodiment is illustrated in which components similar to those in FIG. 1 are designated with similar numbers and a double prime is added to the numbers to indicate the different embodiment. An opening 16" is formed in glass side 12" of envelope 11". A plate 20" is provided with an area larger than the area of opening 16". In this embodiment, no button is formed on plate 20". A depression 24" is formed in the upper surface of plate 20". Depression 24" can contain a gettering material or the like which may be, for example, a flashable getter that is evaporated into envelope 11" through opening 16" (see the description above). A ring of low temperature melting material 25", similar to that described above, is placed on the upper surface of plate 20" surrounding depression 24". The assembly process proceeds as described above.

It should be noted that the vacuum seal can be made either when the indium is molten (>157° C.) or when the indium is solid (<157° C.). To perform the sealing process with low temperature indium (solid), the process is generally as described above, except that more force is required to squeeze the clean indium out from the surface film to form a good bond. Since indium creeps at room temperature, the force applied to the indium to produce the fresh surface can be reduced if one waits for several minutes for the creep to finish the deformation. It should be understood that the low temperature seal can be made with other materials than indium, such as In-Sn alloys, other indium alloys, Sn and its alloys, and other low melting point material and compositions.

In a preferred embodiment, opening 16 is formed in glass side 12 of envelope 11. The components of envelope 11, e.g. sides 12 and 13, edge 15 and/or support frame, are sealed together, for example using glass frit in an inert atmosphere (Ar, $N_2$, etc.) at near atmospheric pressure. Envelope 11, along with any internal electronics, is then baked out in vacuum (below approximately $10^{-6}$ torr) at a temperature as high as possible without damaging the initial seal, etc. Generally, it is desirable to obtain a sealed envelope (electron tube) with an initial vacuum pressure below $10^{-6}$ torr. The preferred conditions include a temperature greater than 350° C. for several hours. Without being removed from high vacuum, the baked out parts are transferred to a station containing an indium button prepared as described above. A flashable getter is evaporated into envelope 11 through opening 16, for example by RF or electrical heating. The evaporation distance is adjusted to give maximum porosity and surface area in envelope 11. In this specific embodiment, a getter ring or non-evaporable getter does not need to be placed in envelope 11.

Next, plate 20/button 21, which has already been heated to the melting point of the indium via induction, etc., is contacted to the glass at opening 16, as described above. Envelope 11 can be at room temperature during this process or it can be heated to reduce the thermal strain. In general, the colder the temperature when the seal is made, the lower the initial pressure in envelope 11. As a minimum, the seal is made at a temperature of at least 200° C. lower than the display outgassing temperature. Once the seal is made, the temperature of the components is reduced as quickly as possible. Envelope 11 is then removed from the vacuum chamber. A coating, such as epoxy or the like can be applied to the exterior and surrounding area of plate 20 to minimize creep of the indium during the lifetime of display 10.

Thus, a method of fabricating a high vacuum field emission display with flat form factor is disclosed which provides for a high vacuum seal with a greater than ten year shelf life. The method is relatively easy and inexpensive to perform and the display can be fabricated with a very flat form factor. A sealed envelope (electron tube) with an initial vacuum pressure below $10^{-6}$ torr is achieved and with a leak rate of less than $2\times10^{-15}$ torr.1/sec.

There are additional benefits to the disclosed sealing process. Before seal, but after vacuum baking of the components, the field emission device (or other electronic structure) may be operated to degass the components by electron beam bombardment. The electron scrub would preferably be performed at higher anode voltages and current than would be experienced during product operation. In addition, reactive gases such as hydrogen could be introduced to clean the field emitters and remove contaminants, such as oxygen, fluorine, chlorine, and sulfur containing species, or the like, and residual hydrogen could be directly sealed into the display by sealing with a high background partial pressure of $H_2$. Furthermore, the material seal can be used with any type of glass because there is no need to match the thermal expansion coefficient. An additional advantage to this novel seal method is that the material seal can be removed nondestructively.

While we have shown and described specific embodiments of the present invention, further modifications and improvements will occur to those skilled in the art. We desire it to be understood, therefore, that this invention is not limited to the particular forms shown and we intend in the appended claims to cover all modifications that do not depart from the spirit and scope of this invention.

What is claimed is:

1. A method of fabricating a high vacuum device with flat form factor comprising the steps of:

providing an envelope including two major, parallel spaced apart glass sides and a continuous edge therebetween;

forming an opening through one of the glass sides of the envelope;

providing a plate with an area larger than the opening in the envelopes the plate including a button formed with an area slightly smaller tan the opening on one side of the plate;

positioning a low temperature melting material on a surface of the plate;

placing the envelope in a substantial vacuum; and positioning the plate over the opening abutting the one of the glass sides outside of the envelope and the low temperature melting material sealingly engaging the one of the glass sides and the plate.

2. A method of fabricating a high vacuum device with flat form factor as claimed in claim 1 including in addition a step of heating the button and low temperature melting material during the positioning process.

3. A method of fabricating a high vacuum device with flat form factor as claimed in claim 2 wherein the step of heating includes heating the button and the low temperature melting material to a temperature at least 200° C. lower than an outgassing temperature of the display.

4. A method of fabricating a high vacuum device with flat form factor as claimed in claim 1 wherein the step of forming the button includes forming a button of material that wets well to the low temperature melting material and remains wetted during the heating step.

5. A method of fabricating a high vacuum device with flat form factor as claimed in claim 1 wherein the steps of providing the plate and forming the button include forming the plate and button as one integral unit.

6. A method of fabricating a high vacuum device with flat form factor as claimed in claim 1 wherein the step of forming the button includes forming a button of one of copper and gold.

7. A method of fabricating a high vacuum device with flat form factor as claimed in claim 1 wherein the low temperature melting material on the surface of the plate includes one of indium and tin.

8. A method of fabricating a high vacuum device with flat form factor as claimed in claim 1 wherein the step of placing the envelope in the substantial vacuum includes placing the envelope in a vacuum below $10^{-6}$ torr.

9. A method of fabricating a high vacuum device with flat form factor as claimed in claim 1 wherein the step of forming the opening includes forming an opening less than 5 mm in diameter.

10. A method of fabricating a high vacuum device with flat form factor as claimed in claim 1 wherein the step of providing the plate includes providing a plate less than approximately 1 mm thick.

11. A method of fabricating a high vacuum device with flat form factor as claimed in claim 1 wherein, prior to the step of positioning the plate over the opening, a flashable getter is evaporated into the envelope through the opening.

12. A method of fabricating a high vacuum display with flat form factor comprising the steps of:

providing an envelope including two major, parallel spaced apart glass sides and a continuous edge therebetween, the envelope including a display with a first of the glass sides forming a face plate of the display;

forming an opening through a second of the glass sides of the envelope;

forming a plate with an area larger than the opening in the envelope and including an integral upraised button on one side with an area slightly smaller than the opening;

positioning a low temperature melting material on the plate around the button;

baking the envelope and the display at a temperature greater than 350° C. for more than an hour;

placing the envelope in a vacuum below $10^{-6}$ torr; and positioning the button in the opening with the plate abutting the one of the glass sides outside of the envelope and the low temperature melting material sealingly engaging the button within the opening.

13. A method of fabricating a high vacuum display with flat form factor as claimed in claim 12 including in addition a step of heating the button and low temperature melting material during the positioning step.

14. A method of fabricating a high vacuum display with flat form factor as claimed in claim 13 wherein the step of heating includes heating the button and the low temperature melting material to a temperature at least 200° C. lower than an outgassing temperature of the display.

15. A method of fabricating a high vacuum display with flat form factor as claimed in claim 13, wherein the step of forming the plate with the integral upraised button includes forming a plate and button of material that wets well to the low temperature melting material and remains wetted during the heating step.

16. A method of fabricating a high vacuum display with flat form factor as claimed in claim 15 wherein the step of forming the plate and button includes forming a plate and button of one of copper and gold.

17. A method of fabricating a high vacuum display with flat form factor as claimed in claim 16 wherein the low temperature melting material around the button includes one of indium and tin.

18. A method of fabricating a high vacuum display with flat form factor as claimed in claim 12 wherein the step of forming the plate includes forming a plate less than approximately 1 mm thick.

19. A high vacuum display with flat form factor comprising:

an envelope including two major, parallel spaced apart glass sides and a continuous edge therebetween, and an opening defined in and extending through one of the glass sides;

a plate with an area larger than the opening in the envelope, the plate being formed with a button having a area slightly smaller than the opening formed on one side of the plate;

a ring of low temperature melting material disposed on one surface of the plate; and the plate positioned over the opening abutting the one of the glass sides outside of the envelope and the low temperature melting material sealingly engaging the plate over the opening.

20. A high vacuum display with flat form factor as claimed in claim 19 wherein the plate and the button are one integral unit.

* * * * *